US006808073B2

(12) United States Patent
Cuisinier

(10) Patent No.: US 6,808,073 B2
(45) Date of Patent: Oct. 26, 2004

(54) BAG ASSEMBLY

(75) Inventor: Jarret P. Cuisinier, 2007 Pacific Ave., Apt. #8, San Francisco, CA (US) 94109

(73) Assignee: Jarret P. Cuisinier, San Francisco, CA (US)

( * ) Notice: Subject to any disclaimer, the term of this patent is extended or adjusted under 35 U.S.C. 154(b) by 51 days.

(21) Appl. No.: 10/132,584

(22) Filed: Apr. 25, 2002

(65) Prior Publication Data

US 2002/0190069 A1 Dec. 19, 2002

Related U.S. Application Data

(60) Provisional application No. 60/286,310, filed on Apr. 25, 2001.

(51) Int. Cl.[7] ..... B65D 21/02

(52) U.S. Cl. ..... 206/554; 206/515; 220/495.07; 383/37

(58) Field of Search ..... 206/554, 515; 220/495.07, 495.09; 383/9, 10, 37

(56) References Cited

U.S. PATENT DOCUMENTS 2,324,440 A * 7/1943 Tormohlen ..... 220/495.07
3,888,406 A * 6/1975 Nippes ..... 206/554
4,417,669 A * 11/1983 Knowles et al. ..... 221/26
4,978,231 A * 12/1990 Ling et al. ..... 383/11
4,989,994 A * 2/1991 Gelbard ..... 383/37
5,803,299 A * 9/1998 Sealy, Jr. ..... 220/495.07
6,102,239 A * 8/2000 Wien ..... 220/495.07
6,398,030 B1 * 6/2002 Smith et al. ..... 206/554

OTHER PUBLICATIONS

Applicant is Not Aware of Any Patents, Publications, or Other Information for Consideration by the Patent Office.

* cited by examiner

*Primary Examiner*—Jim Foster
(74) *Attorney, Agent, or Firm*—Snell & Wilmer L.L.P.

(57) ABSTRACT

A bag assembly with a connection means for temporarily binding nesting bags to each other and preferably for later additionally acting as a closure means for those same bags. In accordance with an exemplary embodiment of the present invention, the assembly is configured such that an adhesive is revealed when a nested bag is removed from the assembly. That same adhesive then provides a closure means for the orifice of the bag.

29 Claims, 3 Drawing Sheets

BAG ASSEMBLY

CROSS-REFERENCE TO RELATED APPLICATIONS

This application claims priority to U.S. Provisional Patent Application No. 60/286,310, filed Apr. 25, 2001 which is hereby incorporated by reference.

BACKGROUND OF THE INVENTION

1. Technical Field

This invention relates to flexible bags, and more particularly, to such bags used for the collection and containment of various articles.

2. Background Information

Simple bag construction is well known in the prior art. Such construction typically involves at least one rectangular-shaped piece of material that is either bonded on three of its sides to another similar sheet or folded upon itself at one of more of these same sides. A fourth edge, generally remains unbound in order to provide an orifice for the deposit and removal of articles to and from the bag. Most commonly, such bags are constructed from polymers and are used for various functions ranging from disposable garbage collection to the preservation of perishables. Closure for such bags is ordinarily provided by tying the orifice off, using additional integral components (e.g. drawstrings, lock seals, etc.) if provided, or employing external components (e.g. clips, twist-ties, etc.) if available. Often, such bags are used in conjunction with rigid bins for support, as with garbage bags, and devices with supporting arms, as with grocery bags. Customarily, an open bag is placed in such a device with the top edge of the unbound side turned inside out and wrapped about the device in a way that lets the bag hang freely.

This arrangement presents several problems for users. The first prevailing problem is the tendency for the bag to fall into the support device as the weight of the bag increases with the collection of more articles. This creates a great hassle for users as the bag becomes difficult to retrieve after such an occurrence. Secondly, such simple bags are very often disposable and thus single use. Therefore, such bags must be replaced after every use. This places a great burden on users, requiring both large amounts of time and effort for each replacement. In addition, and with regard to businesses using janitorial services, such constant replacement can lead to increased service times and may, as a result, also lead to increased costs. Finally, the present means for closing such bags can be wasteful and difficult for users. Most bags depend on a tedious knot for sealing, which requires a significant amount of bag material, leaving less space available for waste and reducing the overall effectiveness of the device. In addition, many users, including children and the elderly, do not have the physical dexterity necessary to tie multiple knots or to utilize complicated integral closure components. Similar problems exist for users using external devices, which often employ similar, but extraneous, mechanisms.

To help remedy the placement problems of the bag relative to the support device, there have previously been attempts to use "selectively activatible" adhesives to further maintain the position of a bag in a rigid, supporting receptacle. Selectively activatible adhesives require users to position the bag properly and then perform some action, usually compression, on the adhesive to activate it. This presents additional problems for users. Foremost, users are required to perform an inherent supplementary step when using assemblies with such adhesives. This naturally requires additional time and effort from users. Moreover, these assemblies generally require repeated direct adhesion to a supporting structure. This too can also cause several problems. First, when used with wastebins, which by their very nature are less than clean, the resulting bond quality between the bag and the support device can be less than desirable because of existing sediment on and around the bond areas. In the same manner, these adhesion bonds can similarly have greater deterioration rates through use and resulting increased strain, often letting the assembly ultimately fall into the support device. Furthermore, since these adhesives have been under lengthy strain and have been dirtied through direct contact with the support device, they can as a result not again be effectively utilized as an adept closure means. Likewise, such uncleanly sediment can represent a health concern since removal of the bag from the support device ordinarily requires direct physical contact by users with the adhesive—allowing even more trash than necessary to come into contact with users. Finally, and with regards to bags of all uses, the adhesive is oftentimes placed in an area that makes eventual closure of the bag excessively difficult, whether it be through integral means, external means, or the unclean and degraded adhesive itself.

Furthermore, "nesting" of bags, or the placing of multiple bags within each other, has been described in the prior art to counter the repeated need for singular, "simple" bags to be replaced. However, such descriptions do not attempt to solve other problems already highlighted—problems such as providing an effortless and effective closure means. Furthermore, there are additional inherent problems with the complicated assemblies presented by the prior art. For example, such previously disclosed nesting assemblies require awkward tearing of the actual bag to separate the used bag from its permanent connection with the other bags. Such tearing motions can be extremely difficult for users such as children, the elderly, or those suffering from arthritis and other ailments. Moreover, such separation can be difficult and precarious for anyone when the contents of the bag are substantial. In such cases, the strained bag can often tear off the intended perforations and spill the bag's contents. Additionally, this tearing can leave behind parts of the bag physically attached to the support device. This, as a result, forces an additional clean-up step. As well, the required tearing actually obligates users to have prolonged physical contact with the area around the orifice of the bag and can even necessitate users to reach into the enclosure, often containing garbage. This too can represent another health concern. In addition, because the nested bags are permanently bonded to each other, they cannot be split up into multiple functioning subassemblies to be placed in several support devices. Thus, such assemblies can be more costly then necessary since they must be shipped in smaller collections and can be more inconvenient since they cannot be divided and placed in varying amounts where needed.

Accordingly, it is desirable to provide a bag assembly that maintains the proper position and orientation of the assembly relative to a support device. It would also be desirable to provide such an assembly that possesses a clean, effective, and easy integral closure means without an additional activation step. It is further desirable to provide a simpler bag assembly that does not require frequent replacement and does not require any tearing of the bag assembly for removal or separation of a bag from the assembly. It is likewise desirable to provide a bag assembly that allows the assembly to be divided into functioning subassemblies for use with multiple support devices.

BRIEF SUMMARY OF THE INVENTION

The present invention provides a bag assembly that utilizes a connection means for temporarily binding nesting bags to each other and preferably for later additionally acting as a closure means for those same bags. In accordance with an exemplary embodiment of the present invention, the assembly is configured such that an adhesive is revealed when a nested bag is removed from the assembly. That same adhesive then provides a closure means for the orifice of the bag.

BRIEF DESCRIPTION OF THE SEVERAL VIEWS OF THE DRAWINGS

Additional aspects of the present invention will become evident upon reviewing the non-limiting embodiments described in the specification and claims taken in conjunction with the accompanying figures, wherein like numerals designate like elements, and:

DETAILED DESCRIPTION OF PREFERRED EXEMPLARY EMBODIMENTS

The following descriptions are of preferred exemplary embodiments only, and are not intended to limit the scope, applicability, or configuration of the invention in any way. Rather the following description provides a convenient illustration for implementing a preferred embodiment of the invention. Various changes may be made in the function and arrangement of elements described in the preferred embodiments without departing from the spirit and scope of the invention as set forth in the appended claims. In addition, while the following detailed description is largely directed to polymer bag assemblies, the present invention is similarly applicable to other flexible bag assemblies composed of other single layer and multi-layer materials, such as aluminum foil, wovens and nonwovens, coated and uncoated paper, films, and the like, and all of which are generally referred to as "bags." Likewise, the present invention is similarly applicable to bags of various sizes, shapes, colorings, and manufacturing processes.

Generally, in accordance with a preferred embodiment of the present invention, an assembly is provided for flexible bags. The assembly is suitably configured to make overall use of such bags easier by way of a connection means. In the preferred embodiment, the connection means temporarily binds nested bags to each other. The connection means may also be used as a closure means, thereby eliminating the need for an external closure means (e.g., clip or tie) or the need for manual tying in order to seal the bag, and instead allows the device to be closed with a simple finessing motion. For example, the connection means may be an adhesive lining the area outside of the bag's orifice. Therefore, the connection means will connect the bag to the bag it is nested within and will later be able to be used for closing the bag when the adhesive is revealed by the separation of the bags.

In accordance with an alternative embodiment of the present invention, the connection means may also be suitably configured to be a "binding," similar to that used in the binding of books. For example, a glue or a tear-away heat binding may be positioned along all or a portion of the edge of multiple nested bags, consequently holding them together. Thus, bags in this assembly could be easily split away from the assembly along the "binding."

Figure 1:
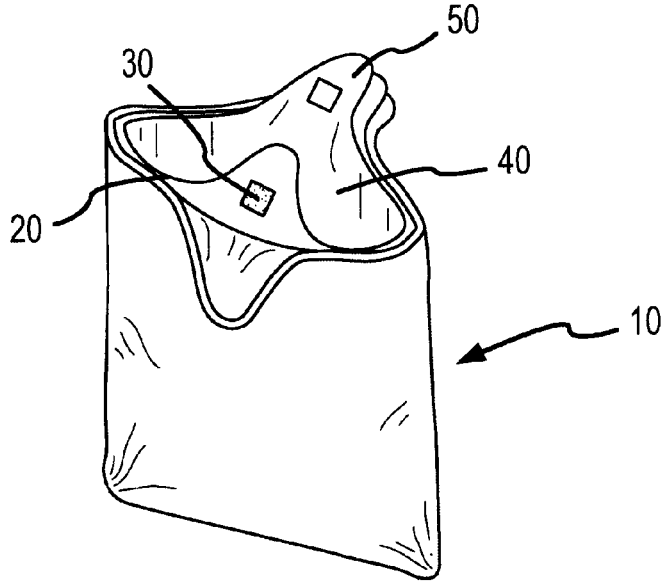
FIG. 1 is a side view of a preferred embodiment of the bag assembly and its exposed connection means.

Thus, with reference to FIG. 1, in accordance with a preferred embodiment of the present invention a bag assembly 10 is shown possessing identical nested bag bodies (each a bag body 20) and identical connection means 30. In accordance with the present exemplary embodiment, each bag body 20 is a standard flexible polymer bag. Bag body 20 is preferably made from compositions such as polyvinyl chloride (PVC), polyvinylidene chloride (PVDC), polyehthylene (PE), or polypropylene (PP). However, in accordance with various alternate embodiments bag body 20 could be substituted with alternative materials. Bag body 20 is suitably constructed to possess an orifice 40.

In accordance with a preferred embodiment of the present invention, each connection means 30 is present in the form of a permanently-active adhesive. The term "adhesive," as used herein, is utilized to refer to any material that exhibits an adherent, tacking, or "sticky" character. Additionally, and in accordance with a preferred embodiment of the present invention, connection means 30 is positioned in two locations and in the form of strip-shaped adhesives. However, in accordance with various alternate embodiments of the present invention, connection means 30 may be present in the form of a single such adhesive or a plurality of such adhesives. In all cases, connection means 30 has sufficient adhering quality in order to connect bag body 20 to its identical nesting partner. Furthermore, and again in accordance with various alternate embodiments, connection means 30 may be used in a variety of shapes, locations, orientations, and forms (including double-sided tapes, glues, etc.) as desired. In addition, adhesive connection means 30 may be refastenable so that connection means 30 may be sufficient to again be used as a closure means for bag body 20.

Furthermore, with continuing reference to FIG. 1 and according to one aspect of the present exemplary embodiment, connection means 30 is situated at the base of wings 50, which are preferably of the same composition and physically integrated as a part of bag body 20. However, and accordance with an alternate embodiment, wings 50 could be bonded to bag body 20 and could furthermore be of a different material composition. Moreover, the number and shape of wings 50 can vary as desired and could be present as a single such wing or any plurality of wings. Additionally, portions of or entire wings 50 may be contrastingly colored (not shown) to indicate the location or locations of connection means 30 or to give users directions or additional information. Wings 50 perform three primary functions: (1) provide increased leverage for holding bag assembly 10 to a support structure, thereby decreasing the need for a stronger adhesive; (2) ease separation of bag bodies from their nesting partners; and, (3) aid in closing orifice 40 of the bag bodies.

Figure 2:
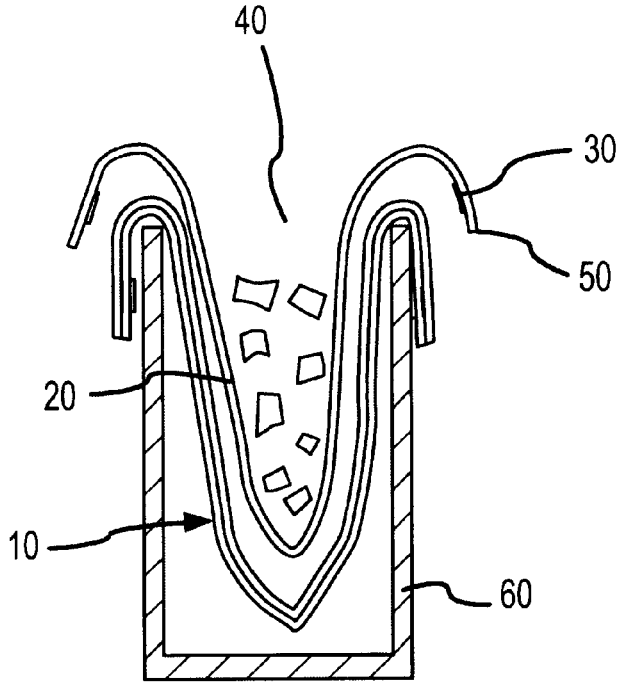
FIG. 2 is a cross-sectional side view of an operating preferred embodiment.
Figure 3A:
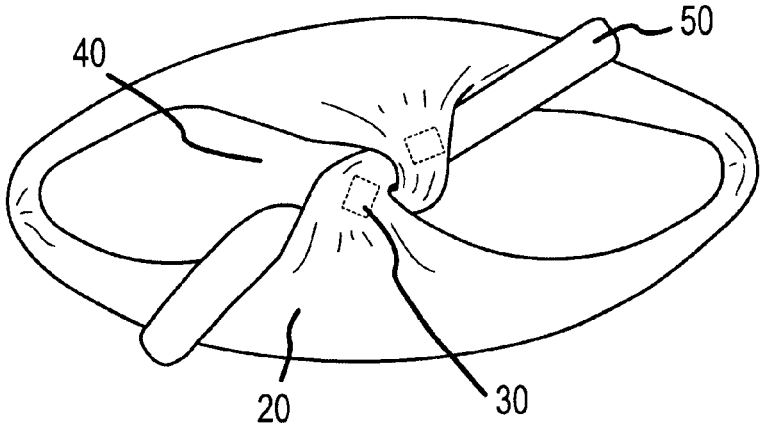
FIG. 3*a* is top view of a closure means of a preferred embodiment.
Figure 3B:
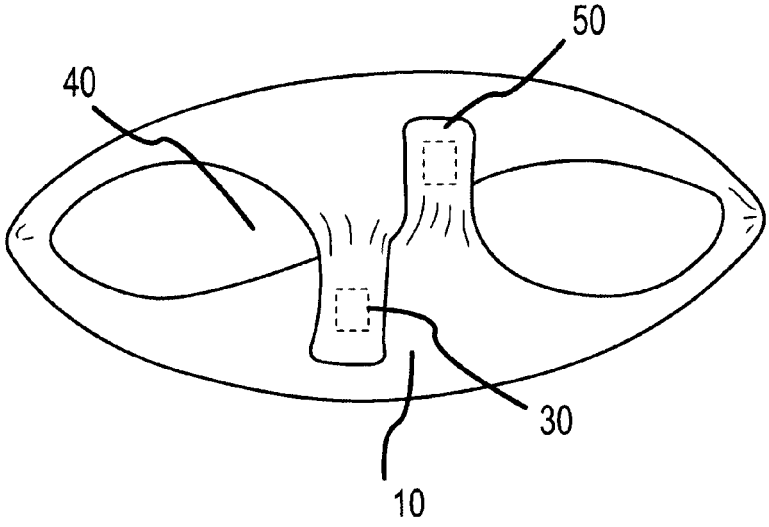
FIG. 3*b* is top view of a closure means of an alternate embodiment.

Thus, in accordance with the preferred embodiment of the present invention and now in continuing reference to FIG. 2, bag body 20 is suitably nested in another identical bag body 20, which is suitably nested in an additional identical bag body 20, and so on. Such multiple bag bodies make up complete bag assembly 10. The number of bag bodies included in bag assembly 10 can generally be of any number, as desirable. A substantially identical connection means 30, mounted on the bottom surface of each wings 50 of each bag body 20, properly maintains the position and orientation of each bag body 20 with its nesting partner or partners. Furthermore, the exposed connection means 30 of the outermost bag body 20 preferably provides an identical connection means between bag assembly 10 and a support device 60. In some cases, however, the outermost connection means 30 may be altered in strength and form to better fit such function and engagement with support device 60. In addition, during shipping exposed connection means 30 of the outermost bag body 20 may be covered with a liner material to preserve the adhesive quality of such external connection means 30. As depicted in FIG. 2, support device 60 is a rigid wastebin of ordinary construction. However, support device 60 could be a number of other structures (e.g. free standing arms, countertops, walls, etc.) that are likewise suitable for supporting bag assembly 10 in an extended or semi-extended position. In use, complete bag assembly 10 is attached to support device 60 and the open and uncovered bag body 20 is filled with articles. Once filled to a desirable level, bag body 20 is grasped by wings 50 for removal. A light pulling motion on wings 50 separates bag body 20 from its identical nesting partner, another bag body 20, and exposes its adhesive connection means 30. The nesting partner hence becomes a new open and uncovered bag body and the cycle continues until bag assembly 10 is exhausted of bag bodies, leaving behind only support device 60 with no further additional cleaning steps. Furthermore, clean adhesive connection means 30 of bag body 20 may now be suitably reused as a sufficient closure means by crossing wings 50 in an overlapping and intersecting manner, as seen in FIG. 3*a*, thereby pressing and adhering each connection means 30 to opposite wings 50. In accordance with a characteristic of an alternate embodiment and with reference to FIG. 3*b*, an alternate closure means is shown using identical connection means 30 and identical wings 50. Instead, wings 50 cross over orifice 40 to connect directly with bag body 20. Additionally, bag body 20 may have colorings (not shown) to give directions of making such closure easier for users. Moreover, and according to an additional aspect of an alternate embodiment and with continuing reference to FIG. 3*b*, bag body 20 may have a handle (not shown) physically integrated for added convenience. However, in accordance with an alternate embodiment, connection means 30 may not be intended to be used again as a closure means and may function exclusively to temporarily bind the nesting bag bodies together.

Furthermore, in use bag assembly 10 can be split into multiple subassemblies by grasping multiple bag bodies by wings 50 and removing through the same separation process already described. Derived multiple bag assemblies are then inserted into other support devices in quantities as needed and also in a similar manner as already described.

Figure 4:
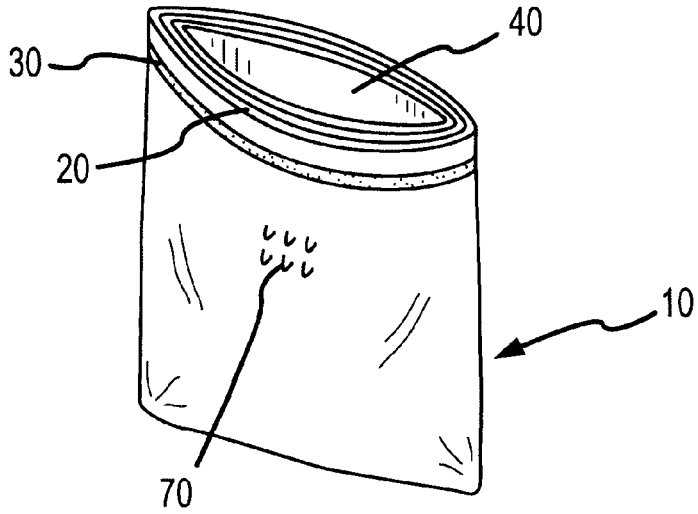
FIG. 4 is a side view of a wing-less alternate embodiment.

In accordance with various alternate embodiments, the number and shape of wings 50 can vary depending on the specific desired use of bag assembly 10. In some cases, wings 50 may even be absent entirely from the bag bodies. Thus, in an alternate embodiment of the present invention and now with reference to FIG. 4, wings 50 may be absent from bag body 20. In such cases, connection means 30 is suitably located around the outside of orifice 40. In addition, and with continuing reference to FIG. 4, connection means 30 is a single, circumferential adhesive positioned around orifice 40. However, and in accordance with various alternate embodiments, connection means 30 could be in a variety of other orientations, sizes, pluralities, and shapes. Bag assembly 10 and its bag bodies, as portrayed in FIG. 4, function in a manner similar to that as the embodiment depicted in FIG. 1. Closure, however, is provided by gathering the bag material in a way that the adhesive binds to itself and other parts of bag body 20, thus providing closure. Furthermore, bag body 20, and identical bag bodies, may possess air holes 70. Air holes 70 are positioned and structured to allow trapped air between the nested bag bodies and trapped air between bag assembly 10 and support device 60 to escape. Moreover, and similarly, bag body 20, and identical bag bodies, could be made of a material possessing "micro-holes," or small holes that let the entire bag "breathe." Such composition may also be preferable when the articles to be contained require gaseous exchange (e.g. fruit). In all such cases, the size of such material holes would not sacrifice the ability of the bag to hold desired articles.

Figure 5:
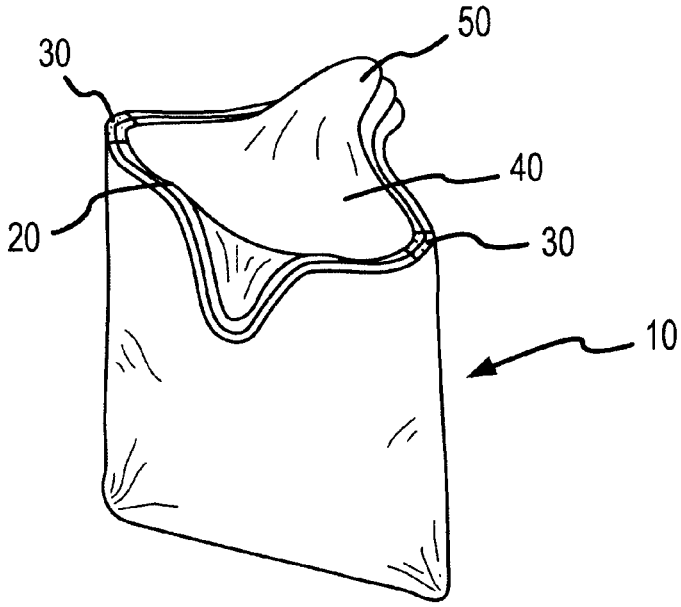
FIG. 5 is side view of a "binding" alternate embodiment.

Now with reference to FIG. 5 and in accordance with another alternate embodiment, a "binding" embodiment of the present invention is described. According to one aspect of this embodiment, connection means 30 is configured in a manner like that of a book binding along the edge of orifice 40. When open and uncovered bag body 20 is full of articles, wings 50 are grasped in a similar manner and through an easy pulling motion bag body 20 is split from bag assembly 10 at temporary "binding" connection means 30. Also in accordance with one aspect of the present embodiment, connection means 30 does not further function as a closure means and instead closure of orifice 40 is likely secured via tying wings 50 or another closure means. Likewise, bag assembly 10 could be used with other adhesive connecting means and closure means, whether permanent or selectively activatible.

Thus, while the principles of the invention have been described in illustrative embodiments, many combinations and modifications of the above-described structures, arrangements, proportions, the elements, materials, and components, used in the practice of the invention in addition to those not specifically described may be varied and particularly adapted for a specific environment and operating requirement without departing from those principles.

I claim:

1. A multiple bag configuration, comprising:

A first bag having a plurality of nested bags, wherein each nested bag is within a previous nested bag; and said first bag and each of said nested bags having an upper perimeter around an opening of each of said first bag and said nested bags, and each of said nested bags being removably attached to said previous nested bag via an adhesive, thereby allowing one of said nested bags to be detached allowing the bag configuration to be separated into multiple independent bag configurations and wherein said adhesive on said first bag has a pull-away strip covering said adhesive.

2. A multiple bag configuration in accordance with claim 1,wherein said adhesive seals said upper perimeter when one of said nested bags is removed from the multiple bag configuration.

3. A multiple bag configuration in accordance with claim 1, wherein said adhesive adheres to a support structure supporting said nested bags.

4. A multiple bag configuration in accordance with claim 1, wherein said adhesive is located on an inner surface of each of said nested bags.

5. A multiple bag configuration in accordance with claim 1, wherein said adhesive is located on an outer surface of each of said nested bags.

6. A multiple bag configuration in accordance with claim 1, wherein said nested bags further comprise a bag closure mechanism.

7. A multiple bag configuration in accordance with claim 6, wherein said bag closure mechanism is a pull cord that collapses a circumference of an upper perimeter of said nested bags.

8. A multiple bag configuration in accordance with claim 6, wherein said bag closure mechanism is a twist tie.

9. A multiple bag configuration in accordance with claim 1, wherein said nested bags further comprise a handle.

10. A multiple bag configuration in accordance with claim 1, wherein said nested bags further comprise wings.

11. A multiple bag configuration in accordance with claim 10, wherein said adhesive is proximate to a base of said wings.

12. A multiple bag configuration in accordance with claim 10, wherein said wings further comprise a handle.

13. A multiple bag configuration in accordance with claim 1, wherein said adhesive comprises a peel-away binding.

14. A multiple bag configuration, comprising:

a first bag having a plurality of nested bags, said nested bags comprising integrated wings, wherein each nested bag is within a previous nested bag, said first bag and each of said nested bags having an upper perimeter around an opening of each of said first bag and said nested bags, and each of said nested bags being removably attached to said previous nested bag via an adhesive, said adhesive proximate to a base of said wings, said adhesive thereby allowing one of said nested bags to be detached allowing the bag configuration to be split into multiple independent and similarly operable bag configurations; and said adhesive seals said upper perimeter when one of said nested bags is removed from said multiple bag configuration.

15. A multiple bag configuration in accordance with claim 14, wherein said nested bags further comprise a handle.

16. A multiple bag configuration in accordance with claim 14, wherein said adhesive is located on an outer surface of each of said nested bags.

17. A multiple bag configuration in accordance with claim 14, wherein said adhesive is located on an inner surface of each of said nested bags.

18. A multiple bag configuration, comprising:

A first bag having a plurality of nested bags, said nested bags comprising integrated wings and wherein each nested bag is within a previous nested bag; and said first bag and each of said nested bags having an upper perimeter around an opening of each of said first bag and said nested bags, and each of said nested bags being removably attached to said previous nested bag via an adhesive, said adhesive proximate to a base of said wings, said adhesive thereby allowing one of said nested bags to be detached allowing the bag configuration to be separated into multiple independent bag configurations.

19. A multiple bag configuration in accordance with claim 18, wherein said adhesive seals said upper perimeter when one of said nested bags is removed from the multiple bag configuration.

20. A multiple bag configuration in accordance with claim 18, wherein said adhesive adheres to a support structure supporting said nested bags.

21. A multiple bag configuration in accordance with claim 18, wherein said adhesive is located on an inner surface of each of said nested bags.

22. A multiple bag configuration in accordance with claim 18, wherein said adhesive is located on an outer surface of each of said nested bags.

23. A multiple bag configuration in accordance with claim 18, wherein said nested bags further comprise a bag closure mechanism.

24. A multiple bag configuration in accordance with claim 23, wherein said bag closure mechanism is a pull cord that collapses a circumference of an upper perimeter of said nested bags.

25. A multiple bag configuration in accordance with claim 23, wherein said bag closure mechanism is a twist tie.

26. A multiple bag configuration in accordance with claim 18, wherein said nested bags further comprise a handle.

27. A multiple bag configuration in accordance with claim 18, wherein said wings further comprise a handle.

28. A multiple bag configuration in accordance with claim 18, wherein said adhesive comprises a peel-away binding.

29. A multiple bag configuration in accordance with claim 18, wherein said adhesive on said first bag has a pull-away strip covering said adhesive.

* * * * *